US005784747A

United States Patent [19]

Girardot et al.

[11] Patent Number: 5,784,747

[45] Date of Patent: Jul. 28, 1998

[54] CLEANSING PUFF

[75] Inventors: Richard M. Girardot, Cincinnati, Ohio; Craig A. Hawkins, Ashiya, Japan; Ronald Kortelink, Pittsford, N.Y.; Frank Lodi, Niles; Richard R. Tompkins, Glendale Heights, both of Ill.

[73] Assignee: The Procter & Gamble Company, Cincinnati, Ohio

[21] Appl. No.: 548,361

[22] Filed: Nov. 1, 1995

[51] Int. Cl.[6] ..... A47L 17/08; A47K 7/02

[52] U.S. Cl. ..... 15/229.11; 15/209.1

[58] Field of Search ..... 15/208, 209.1, 15/229.11, 229.12

[56] References Cited

U.S. PATENT DOCUMENTS

| | | | |
|---|---|---|---|
| 210,560 | 12/1878 | Robertshaw . | |
| 992,821 | 5/1911 | Stewart . | |
| 1,533,868 | 4/1925 | Kingman | 15/229.11 |
| 1,854,140 | 4/1932 | Hopkins . | |
| 1,897,778 | 2/1933 | Wallace | 15/229.11 |
| 2,130,825 | 9/1938 | Bergan . | |
| 2,350,357 | 6/1944 | Kelman | 15/229.11 |
| 2,581,779 | 1/1952 | Abraham . | |
| 2,582,640 | 1/1952 | Maddox . | |
| 2,764,160 | 9/1956 | Alexander et al. . | |
| 2,784,519 | 3/1957 | Ralston et al. . | |
| 3,266,109 | 8/1966 | Thomas . | |
| 3,307,870 | 3/1967 | Archer . | |
| 3,336,618 | 8/1967 | Day | 15/229.11 |
| 3,343,196 | 9/1967 | Barnhouse | 15/229.11 |
| 3,540,224 | 11/1970 | Pogonowski . | |
| 3,602,953 | 9/1971 | Thomas . | |
| 3,629,909 | 12/1971 | Riley . | |
| 3,872,547 | 3/1975 | Caveneny et al. . | |
| 3,913,187 | 10/1975 | Okuda . | |
| 3,988,850 | 11/1976 | Steinman . | |
| 4,097,966 | 7/1978 | Lefnaer . | |
| 4,128,918 | 12/1978 | Wenk . | |
| 4,183,120 | 1/1980 | Thorne . | |
| 4,199,835 | 4/1980 | Heyer | 15/229.11 |
| 4,206,948 | 6/1980 | Shimizu . | |
| 4,209,661 | 6/1980 | Pate et al. . | |
| 4,214,351 | 7/1980 | Wenk . | |
| 4,455,717 | 6/1984 | Gray . | |
| 4,462,135 | 7/1984 | Sanford | 15/229.12 |
| 4,548,201 | 10/1985 | Yoon . | |
| 4,807,333 | 2/1989 | Boden . | |
| 4,872,242 | 10/1989 | Allan . | |
| 4,896,403 | 1/1990 | Vouros . | |
| 4,921,423 | 5/1990 | Kesling . | |
| 5,025,596 | 6/1991 | Heyer | 15/229.11 |
| 5,090,691 | 2/1992 | Pollock . | |
| 5,144,744 | 9/1992 | Campagnoli . | |
| 5,156,300 | 10/1992 | Spahni et al. . | |
| 5,182,838 | 2/1993 | Stenner . | |
| 5,193,251 | 3/1993 | Fortsch . | |
| 5,233,730 | 8/1993 | Milne et al. . | |
| 5,267,373 | 12/1993 | Chisek . | |

(List continued on next page.)

FOREIGN PATENT DOCUMENTS

| | | | |
|---|---|---|---|
| 1124555 | 10/1956 | France | 15/229.11 |
| 525464 | 1/1984 | France . | |
| 1 025 960 | 3/1958 | Germany . | |
| 642051 | 8/1930 | United Kingdom | 15/229.11 |
| 398337 | 9/1933 | United Kingdom | 15/229.11 |
| 545988 | 6/1942 | United Kingdom . | |
| 727874 | 4/1955 | United Kingdom | 15/229.11 |
| 2 016 579 | 9/1979 | United Kingdom . | |

*Primary Examiner*—Randall Chin

*Attorney, Agent, or Firm*—William Scott Andes; E. Kelly Linman; Jacobus C. Rasser

[57] ABSTRACT

A polymer mesh puff is formed from at least one tube of open cell mesh stretched between a pair of opposing supports. The tube of mesh is bound about a centerpoint by a substantially permanent, non-abrasive mesh binding member. The tube is released from the supports so as to form a plurality of random folds, thereby forming a substantially spherical cleaning implement for use in personal hygiene applications.

4 Claims, 7 Drawing Sheets

U.S. PATENT DOCUMENTS 5,295,285 3/1994 Shely .
5,317,787 6/1994 Fortsch .
5,377,388 1/1995 DeBever .
5,379,496 1/1995 Krauss .
5,402,971 4/1995 Bower .
5,465,452 11/1995 Girardot ..... 15/229.11
5,530,985 7/1996 Tsai ..... 15/229.11

CLEANSING PUFF

TECHNICAL FIELD

This invention relates generally to the field of scrubbing and cleansing implements and methods for making such implements. More particularly, this invention relates to an improved polymer mesh puff for personal hygiene, and an improved method for its manufacture.

BACKGROUND OF THE INVENTION

Various scrubbing devices are known and available in the art. For instance, balls of polymer mesh have been used to scrub dishes, pans, other household items, and human skin. A scrubbing apparatus used for personal hygiene, commonly referred to as a polymer mesh puff, is often used in cleansing the skin. These polymer mesh puffs are typically manufactured from one or more pieces of synthetic open cell mesh which are bound together and manipulated into a plurality of random folds to form a generally rounded shape, or puff. The open cell structure of the mesh advantageously forms a structure which effectively cleans the body, and from which dirt is easily rinsed and which dries relatively quickly. In addition, synthetic material is highly resilient, resulting in a puff which retains its shape throughout use. These puffs are formed by binding a piece of tubular mesh or a sheet of mesh about a centerpoint with a piece of string, and then forming a series of random folds about this centerpoint through various means of manipulation.

For example, U.S. Pat. No. 3,343,196 to Baruhouse discloses a method for manufacturing a puff from an open cell mesh. A series of mesh sheets are stitched at a common center point and then fed through an alignment ring which separates the sheets into a generally circular profile. The sheets are next cut and compressed such that, during the compression phase, a series of folds are formed. A metallic staple is used to permanently fasten the folds together about a centerpoint.

U.S. Pat. No. 5,144,744 to Campagnoli, incorporated by reference herein, discloses another method for manufacturing a puff from a polyethylene mesh having a diamond cell structure. The tubular mesh is stretched in a direction transverse to its longitudinal axis (i.e. stretched transverse to the theoretical centerline of the tube). The stretched tube is then mounted between a pair of opposing curved supports. The tube is then bound at a centerpoint along its transverse axis and is selectively released from the supports such that the end result is a substantially spherical cleansing implement, formed by a series of random folds of mesh material.

With regard to the structure used for binding the tube of mesh, Campagnoli generically teaches the use of a "plastic strip" for binding. One type of "plastic strip" used for this purpose is a plastic, ratchet type, cable-tie device. These tie devices are typically used for arranging and binding bundles of wires or cables in the electrical industry, binding plants in agriculture, or for closing sacks, bags and similar objects. Typically, these tie devices consist of a toothed band for encircling the objects to be bound and a locking head having a pawl, or similar internal locking structure, for securing the band in place. Although suitable for binding polymer mesh puffs, the use of these tie devices as mesh binding members can pose several problems. These problems include a potential for abrasion and injury (e.g., cutting, scratching or scraping the user) from sharp edges or protrusions on the plastic strip after the tail end of the toothed band is trimmed off.

In addition to the use of plastic strips, it is well known in the art to use a fabric or synthetic cord, such as string or twine, for binding a polymer mesh puff. However, these fabric cords have a tendency to disintegrate or rot over time from the cyclical wetting and drying of the cord during use, and frequently come unraveled resulting in a short useful life of a puff. Cords also come unraveled because of improper knotting during manufacture, and because it is difficult to tie a tight knot and retain tightness as the knot is secured. Polymer mesh puffs which exhibit the above-described characteristics are generally undesirable because consumers become dissatisfied with the products.

Hence, there has been an unaddressed need for a mesh binding member which can permanently secure a mesh puff about a centerpoint without causing injury to the user. More specifically, the mesh binding member should be free of any sharp surfaces which might be capable of cutting, scratching, abrading, or otherwise undesirably contacting the user while adequately encircling and binding the polymer mesh puff so that its shape will be maintained.

SUMMARY OF THE INVENTION

A scrubbing apparatus is provided which comprises at least one tube of open cell mesh and a substantially non-abrasive, substantially non-injurious mesh binding member for substantially permanently binding the tube(s) of mesh. The scrubbing apparatus is formed by stretching each tube of mesh transverse to a longitudinal axis between a pair of opposing curved supports. The mesh binding member is used to substantially encircle and bind the tube of mesh, preferably about its effective centerpoint. If the scrubbing apparatus is comprised of more than one tube of mesh, the tubes are collectively bound by the mesh binding member about the aggregate of the effective centerpoints of the tubes, thus forming a common centerpoint. Each tube of mesh is then selectively released from the opposing supports and manipulated such that a series of random folds are formed. The free ends of the folds preferably form a scrubbing apparatus of predetermined shape. If the effective centerpoint of each tube of mesh is generally equidistant between the opposing supports along the transverse axis of the tube of mesh, a scrubbing apparatus of generally spherical shape will be formed.

Five preferred mesh binding members are provided for substantially permanently binding a single tube of mesh about its effective centerpoint or a plurality of tubes about the aggregate of the effective centerpoints. A locking tether having a cord and cleat may be used to substantially encircle and bind the tube(s) of mesh. The cleat may permanently secure the cord about the tube(s) of mesh by a combination of mechanical and frictional forces or crimping. Another type of mesh binding member may be an interlocking ring having a plurality of angled projections which engage at least one notch disposed on the interlocking ring so as to form the ring into a generally circular shape about the tube(s) of mesh. Yet another type of mesh binding member may be a continuous elastic ring where in the elastic ring constricts about the tube(s) of mesh. Still yet another type of mesh binding member may be a fixed circumference breakaway tie having a locking barb on a feed strip which is connected by a flexible member to a boot. A further type of mesh binding member may be formed by heat pinching the tube(s) of mesh while stretched between the opposing supports.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENTS

Reference will now be made in detail to the present preferred embodiments and preferred methods for making the invention, examples of which are illustrated in the accompanying drawings wherein like numerals indicate the same elements throughout the views. Because it is believed the invention and its structure will be better understood from a knowledge of the method of making that structure hereunder, a preferred method of doing so will now be described with reference to FIGS. 1 through 3.

Figure 1:
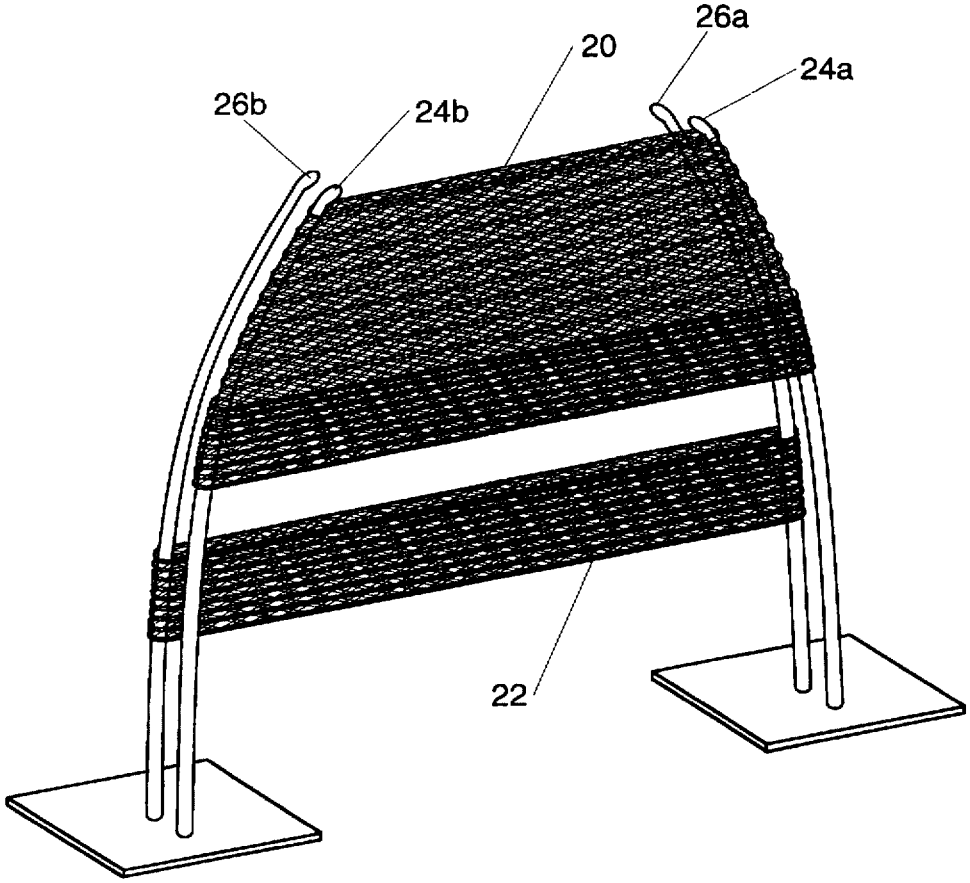
FIG. 1 illustrates a step in the process of manufacturing a polymer mesh puff in accordance with the present invention, illustrating the stretching of two separate tubes of mesh in a direction transverse to their respective longitudinal axes.
Figure 2:
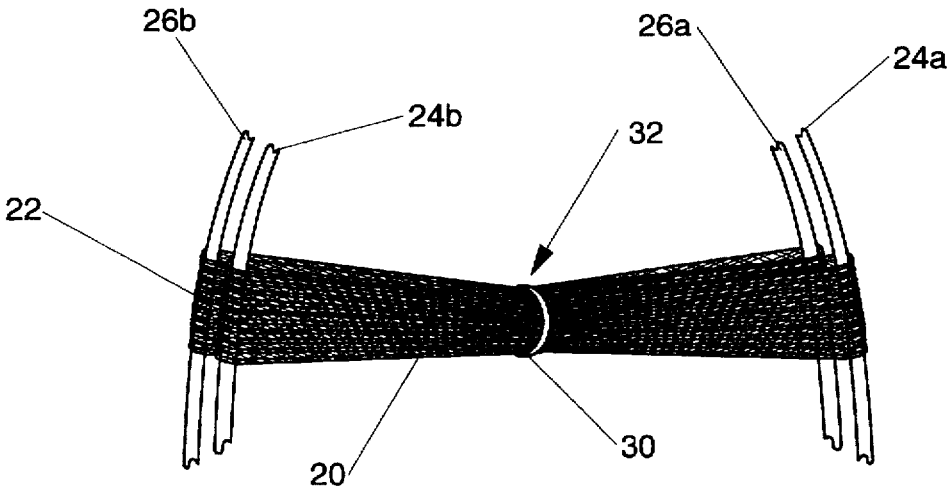
FIG. 2 illustrates a preferred step of collectively binding the two stretched tubular pieces of mesh of FIG. 1 about the aggregate of their effective centerpoints.

FIG. 1 illustrates two tubes of mesh 20 and 22 preferably stretched transverse to their longitudinal axes (i.e, stretched transverse to the theoretical centerline of each tube of mesh) between a pair of opposing curved supports 24*a*, 24*b*, 24*a* and 24*b* and gathered at a point toward the base of the supports. While in this stretched condition, the tubes of mesh are securely bound by a non-abrasive substantially permanent mesh binding member 30 thus forming a common centerpoint 32 for the collective tubes of mesh. The term "common centerpoint", as used herein, shall connote a position generally formed from the aggregate or aligned effective centerpoints of each tube of mesh. The term "effective centerpoint", as used herein, shall connote a position generally along the transverse axis of each tube of mesh while stretched between the supports (e.g., 24*a*, 24*b*, 26*a*, 26*b*). Preferably, the effective centerpoint is located generally near the intersection of the transverse and longitudinal axes of each tube of mesh, although other locations along the transverse axis are equally suitable for alternative embodiments.

Figure 3:
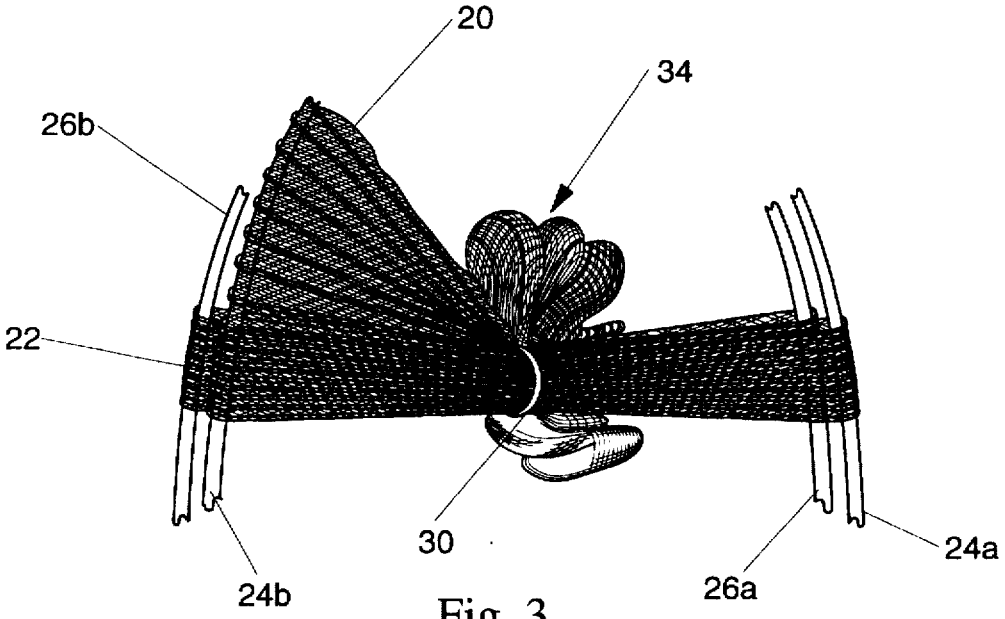
FIG. 3 illustrates the step of selectively releasing and manipulating part of one of the separate tubes of mesh from the curved supports of FIG. 1.
Figure 4:
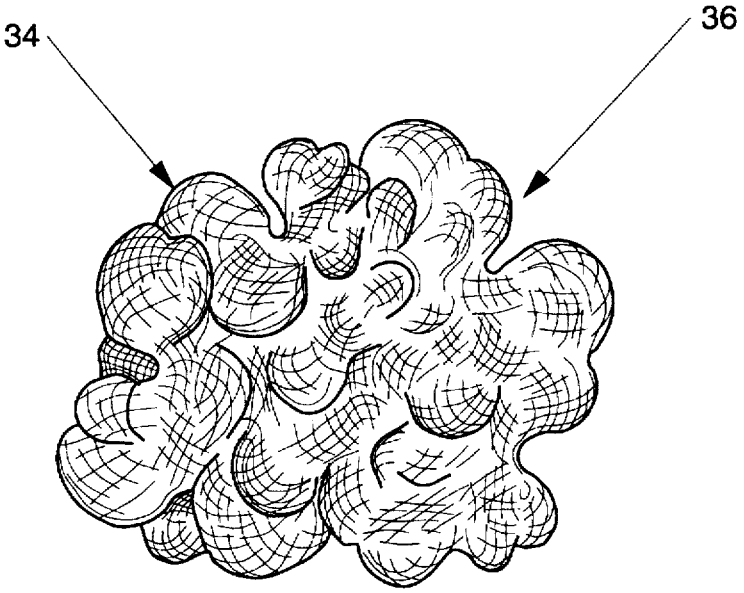
FIG. 4 is a perspective view of a polymer mesh puff made in accordance with the present invention.

After the tubes of mesh (e.g., 20, 22) are bound by mesh binding member 30, each tube of mesh is selectively released from its respective curved support and manipulated such that a plurality of random folds 34 are formed about common centerpoint 32 as best illustrated in FIG. 3. Preferably, the collective folds form a polymer mesh puff 36, as shown in FIG. 4, having a substantially spherical shape. Although the method of manufacturing polymer mesh puff 36 has been described as comprising two tubes of mesh bound so as to form a common centerpoint, it will be understood by one skilled in the art that the above-described method may also be adapted to bind a single tube of mesh about its effective centerpoint so as to form another embodiment of puff 36.

Having illustrated the preferred method of manufacturing polymer mesh puff 36, the preferred structure of puff 36 will now be described. Preferably, each tube of mesh (e.g., 20, 22) has a plurality of individual open cells. The structure of each cell, which is defined by both the size and shape of the individual cells, may be widely varied without deviating from the scope of this invention or the effectiveness of the resultant puff. In a preferred arrangement, the individual cell shape will take the form of diamond mesh. Preferably, each tube of mesh is formed from any highly resilient polymer, such as polyethylene, although it will be understood by one skilled in the art that other polymers, metals, fibrous blends, or similar materials may be suitable. Similarly, the physical properties (e.g., molecular weight, molecular weight distribution, melt index, etc.) of a material used to form each tube of mesh may be varied as desired to achieve the suitable end characteristics (e.g., resiliency, softness, etc.) for its intended use without adding to or subtracting from the scope of this invention.

Five preferred mesh binding members for encircling and binding at least one tube of mesh so as to form a centerpoint 32 will now be described. Each preferred mesh binding member 30 is non-abrasive and substantially permanent. The term "non-abrasive", as used herein, shall connote a mesh binding member 30 which, in use, is substantially free of rough edges, protrusions or outwardly extending structures which may tend to cause undesirable tactile consequences (e.g., cutting, slicing, scrapping, abrading or otherwise injuring the user at any sensitive surface) during use. In addition, the structure of each preferred mesh binding member 30 is such that it will substantially permanently bind, without unraveling or otherwise unbinding, polymer mesh puff 36 under ordinary conditions such as manufacturing, distribution, sale, and use.

Figure 5:
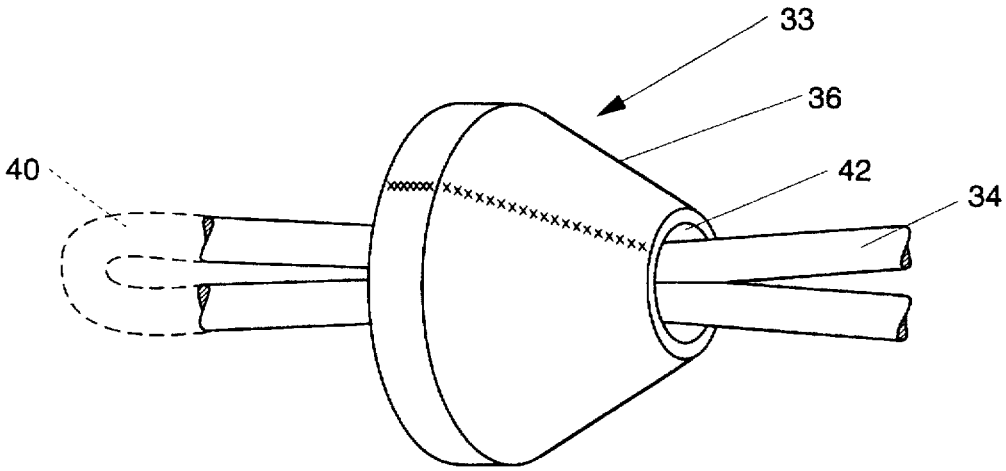
FIG. 5 is an enlarged partial perspective view of a cord and cleat type of mesh binding member for a polymer mesh puff made in accordance with the present invention.
Figure 6:
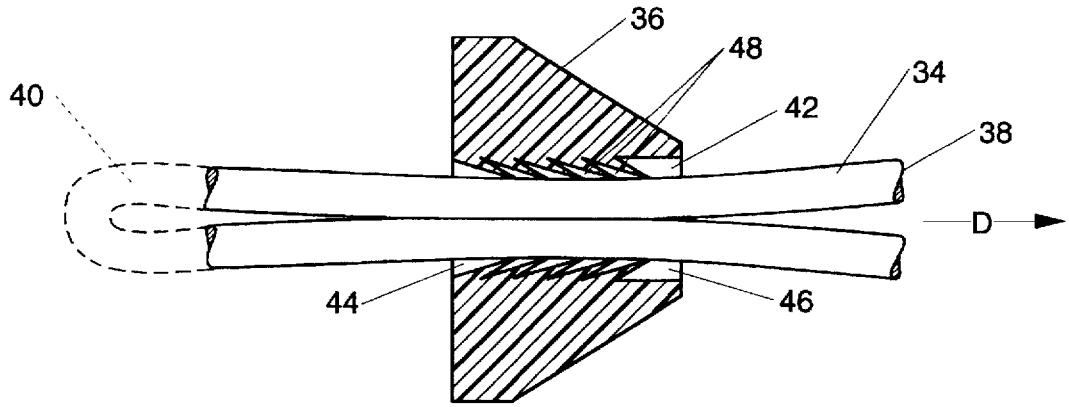
FIG. 6 is a cross sectional view of a cord and cleat of FIG. 5 as the cord is being drawn through the cleat.
Figure 7:
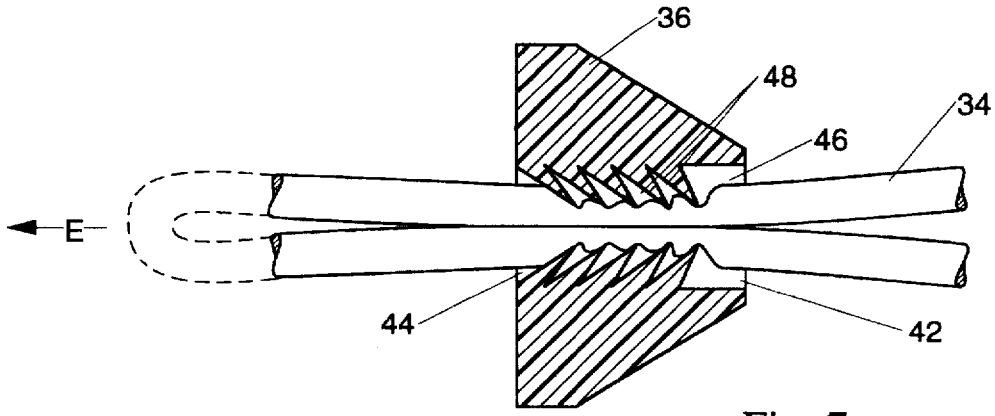
FIG. 7 is a cross sectional view of a cord and cleat of FIG. 5 after tightening is complete and back tension is exerted on the cord.

As best illustrated in FIGS. 5 through 7, one such binding device is locking tether 33 having a flexible cord 34 and locking cleat 36. Wedge or cone shaped cleats with internal locking structures (e.g., serrations, tapered inserts, slide locks) have been used to restrict the movement of cords and wires in articles of manufacture such as clothing, exercise and sports equipment, and electrical boxes. For example, these cleat-like structures have been used to engage and secure cords in articles of manufacture such as shoes, jackets, bags, water sport equipment, and handles for exercise devices. In the electrical field, locking cleats have been used to anchor electrical conductors to electrical outlet boxes at the location where the conductor passes through an opening in the box.

Although locking cleat 36 is similar in configuration to the above-described cleat-like structures, cleat 36 of locking tether 33, functions to engage cord 34 such that cord 34 maintains a substantially permanent binding, force about tubes of mesh 20 and 22. Preferably, cord 34 when cooperating with cleat 36, has free ends 38 and closed end 40. Passage 42 extends the length of cleat 36, having an entrance portion 44 and an exit portion 46. Disposed about the inside diameter of passage 42 are a plurality of individually angled teeth 48 sized and angled such that cord 34 may traverse passage 42 in a direction D without substantial interference. However, if a tensile force is applied to cord 34, as would occur when fully tightened about tubes of mesh, teeth 48 will engage cord 34 as best illustrated in FIG. 7, thereby preventing release of locking tether 33. Obviously, cleat 36 may be sized to accommodate a wide variety of outside diameters of cord 34. Although cleat 36 is preferably comprised of passage 42 and teeth 48, the engagement function of cleat 36 may obviously be achieved by other structural equivalents. For example, cleat 36 may incorporate a slit extending substantially over its length, such that cleat 36 may be crimped permanently about cord 34.

It should be understood that cord 34 may be formed from any flexible fabric or synthetic material, such as polypropylene, nylon, or the like, which will be substantially immune from deleterious effects of cyclical exposure to water or other liquids likely to be encountered during use. Cleat 36 may preferably be constructed of any substantially rigid material such as metal, wood, fiberglass, or plastic. However, for economic reasons, cleat 36 is most preferably composed of acetal plastic formed by injection molding, although other processes such as plastic welding or adhesive connection of appropriate parts could also be utilized.

Tubes of mesh 20 and 22 are preferably bound with locking tether 33 by first substantially encircling the tubes about the effective centerpoints with cord 34. The ends of cord 34 are then inserted, preferably simultaneously, through entrance portion 44 until both ends emerge from exit portion 46. Cord 34 is pulled through cleat 36 until cord 34 is tightened sufficiently to pinch and bind the tubes of mesh. In this condition, angled teeth 48 will lock cord 34 in place to provide substantially permanent binding of a puff due to a backward force E caused by tension in the cord. The free ends of the cord can be used as a handle or a hanger for the puff.

Figure 8:
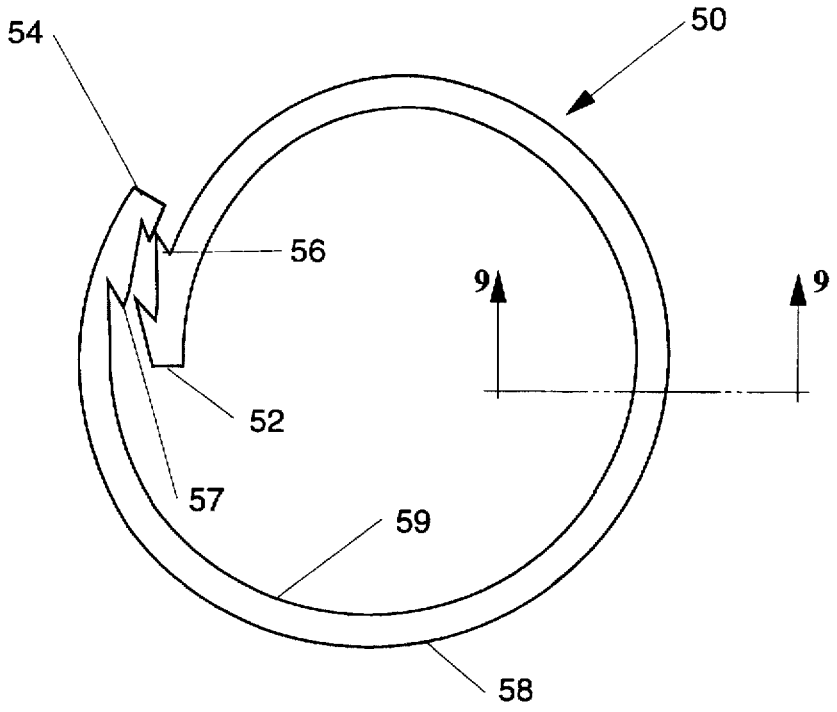
FIG. 8 is an enlarged plan view of an interlocking ring type of mesh binding member for a polymer mesh puff made in accordance with the present invention.
Figure 9:
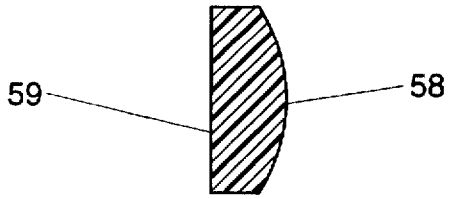
FIG. 9 is an enlarged cross sectional view of the interlocking ring of FIG. 8.

Another preferred mesh binding member 30 is interlocking ring 50, as best shown in FIGS. 8 and 9. Interlocking rings, more commonly known as squeeze clamps, have been used in the plumbing and automotive industries for securing flexible hoses and tubes to interconnecting structures (e.g., ferrules, pipe nipples, nozzles etc.). These squeeze clamps generally include a flexible band which may be closed into a substantially circular shape by means of interlocking jaws, serrations or the like. They are often removable from the interconnecting structure so as to facilitate service, repair, or cleaning of the hose or tube.

Interlocking ring 50 is generally similar in structure but not function to the above-described squeeze clamps. Interlocking ring 50 has a first end 52 and a second end 54. Preferably, first end 52 has a plurality of angled projections 56. Second end 54 preferably has a plurality of notches 58 which cooperate with projections 56 such that, if interlocking ring 50 is formed into a generally circular shape, angled projections 56 and notches 58 may hook together so as to substantially permanently close and secure interlocking ring 50. While in this closed substantially circular shape, ring 50 will be subject to internal tensile forces acting from the ring's neutral bending axis (i.e., an axis along which no force is acting) to outer surface 58 and internal compressive forces acting from the ring's neutral bending axis to inner surface 59. This combination of tensile and compressive forces will generally be acting against the engagement of angled projections 56 and notches 57 to return ring 50 to its relaxed state. Interlocking ring 50 may be formed from any flexible resilient material, such as acetal plastic, which will be substantially immune from deleterious effects of cyclical exposure to water or other liquids likely to be encountered during use.

Tubes of mesh 20 and 22 are preferably bound by first stretching open interlocking ring 50 and substantially encircling the tubes of mesh with it. Interlocking ring 50 may then be secured by engaging angled projections 56 with notches 58 until they cooperate as described above.

Figure 10:
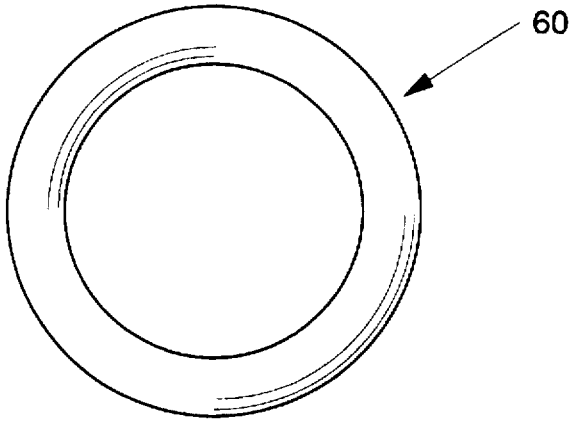
FIG. 10 is an enlarged plan view of a continuous elastic ring type of mesh binding member for a polymer mesh puff made in accordance with the present invention.
Figure 11:
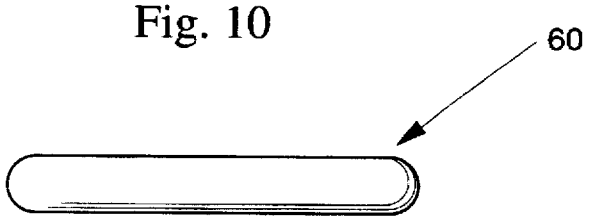
FIG. 11 is an enlarged frontal view of the continuous elastic ring of FIG. 10.
Figure 12:
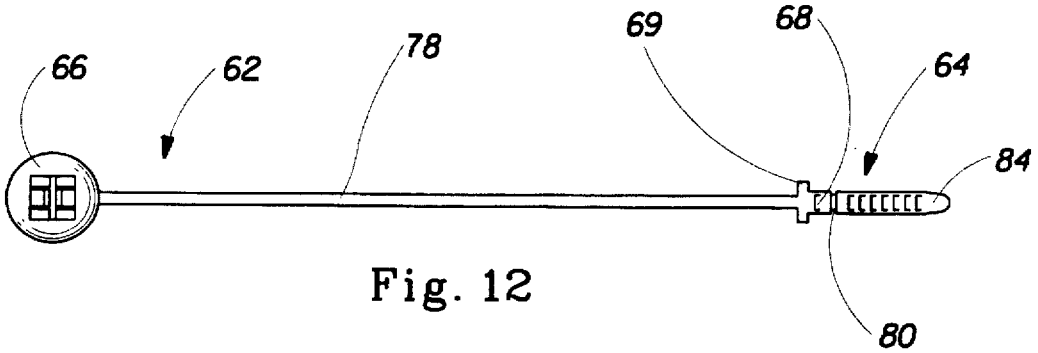
FIG. 12 is an enlarged top plan view of a break-away tie type of mesh binding member for a polymer mesh puff made in accordance with the present invention.
Figure 13:
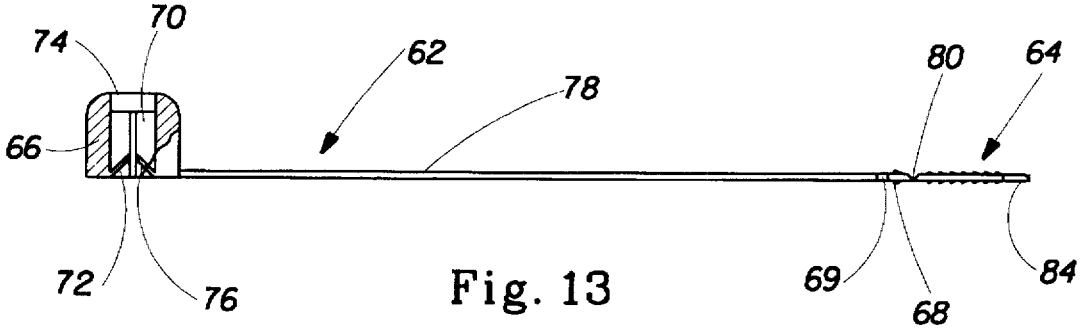
FIG. 13 is an enlarged cross sectional view of the break-away tie of FIG. 12.
Figure 14:
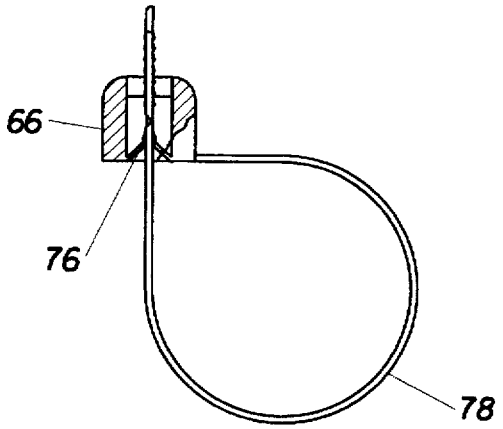
FIG. 14 is an enlarged cross sectional view of the break-away tie of FIG. 12 wherein the barbs have engaged the bore fingers.

Yet another preferred mesh binding member is continuous elastic ring 60, as best illustrated in FIGS. 10 and 11. Elastic polymer rings, more commonly known as O-rings, are generally used in the plumbing field within fluidic and gaseous devices (e.g., valves, accumulators, pumps and the like) as a means of preventing fluid flow from one section of the device to another. In addition, these elastic O-rings may also be used in the medical and veterinary fields in procedures where it would be necessary to pinch an organ or tissue so as to restrict the flow of blood thereto (e.g., castration procedures for domesticated animals).

Ring 60 is generally similar in structure and composition, but not function, to the above-described O-rings. Ring 60 preferably has a continuous generally circular form and is sized to remain in tension when encircling tubes of mesh so that a substantially permanent binding force is exerted. Preferably, ring 60 may be formed from any flexible resilient material which will be substantially unaffected by the deleterious effects of cyclical exposure to water or other liquids likely to be encountered during use. More preferably, ring 60 is formed from natural rubber or a highly resilient polymer such as silicone, polyisoprene, or the like.

A tube of mesh is bound with elastic ring 60 by first stretching and translating elastic ring 60 down one support (e.g., 24*a*, 24*b*, 26*a*, or 26*b*). After a tube of mesh is stretched and placed on the supports, elastic ring 60 is brought up over the top of the support and secured about the centerpoint of the tube.

Still another preferred mesh binding member is break-away tie 62 as best illustrated in FIGS. 12 to 15. Preferably, break-away tie 62 has a feed strip 64 and a boot 66. Feed strip 64 preferably has at least one locking barb 68 which is disposed on feed strip 64 such that break-away tie 62 may sufficiently encircle and bind tubes of mesh 20 and 22. Preferably shoulder stop 69 is adjacent barb 68.

Boot 66 preferably has a bore 70 with an inlet portion 72 and a discharge portion 74. Disposed within bore 70 adjacent inlet portion 72 is at least one angled finger 76. Connecting feed strip 64 with boot 66 is flexible member 78.

Preferably, feed strip 64 has a predetermined fracture point 80 which may be formed as an area of reduced cross section or other stress inducing geometry (e.g., perforations or the like) such that a detachable portion 84 may be easily removed from break-away tie 62 by preferably bending or twisting detachable portion 84 about predetermined fracture point 80.

Preferably, feed strip 64 and flexible member 78 of break-away tie 62 may be formed from any flexible material which will be substantially immune from the deleterious effects of cyclical exposure to water or other liquids likely to be encountered during use. More preferably, both feed strip 64 and flexible member 78 are formed from a suitable resilient polymer such as acetal or the like. Boot 66 may preferably be constructed of any substantially rigid material such as metal, wood, fiberglass, or plastic. However, for economic reasons and structural compatibility with flexible member 78, boot 66 is most preferably composed of acetal formed by injection molding, although other processes such as plastic welding or adhesive connection of appropriate parts could also be utilized.

Figure 15:
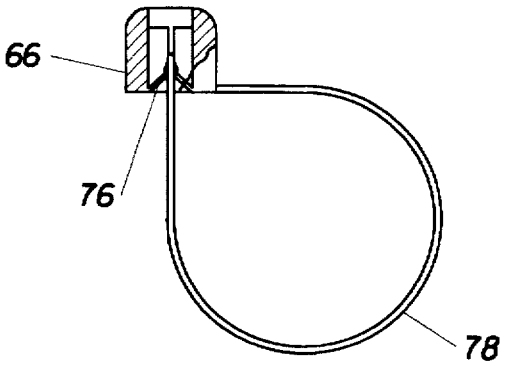
FIG. 15 is an enlarged cross sectional view of the break-away tie of FIG. 14 wherein a detachable portion has been removed at a predetermined fracture point.

Tubes of mesh 20 and 22 are preferably bound with break-away tie 62 by first substantially encircling tubes of mesh 20 and 22 about the aggregate of the effective centerpoints 28 with flexible member 78. Break-away tie 62 may then be tightened about tubes of mesh 20 and 22 by inserting feed strip 64 through inlet portion 72 of boot 66 so that it emerges from exit portion 74. Feed strip 64 is selectively pulled through boot 66 until angled fingers 76 engage barb 68 and shoulder stop 69 contacts boot 66 thus preferably forming break-away tie 62 into a fixed circumference. With tension, twisting, or bending of feed strip 64 possible after shoulder stop 69 contacts boot 66, detachable portion 84 may be removed from feed strip 64 such that barb 68 still engages angled fingers 76, as best illustrated in FIG. 15, while the rough edge remains within the boot. This insures that tie 62 will be substantially free of any edges or protrusions which could pose a risk of injury to the user of polymer mesh puff 36. If more than one barb 68 is disposed on feed strip 64, tie device 62 may be manipulated into a predetermined number of fixed circumferences corresponding to the number of barbs 68 provided. Preferably, barb 68 and shoulder stop 69 are positioned on feed strip 64 such that when break-away tie 62 encircles tubes of mesh 20 and 22, flexible member 78 remains in a stretched condition thus pinching and binding tubes of mesh 20 and 22 so as to form a common centerpoint 32. Angled fingers 76 preferably engage barb 68 thereby preventing significant movement of feed strip 64 in a direction from exit portion 74 to inlet portion 72 so that the stretched condition of flexible member 78 is substantially permanent.

Figure 16:
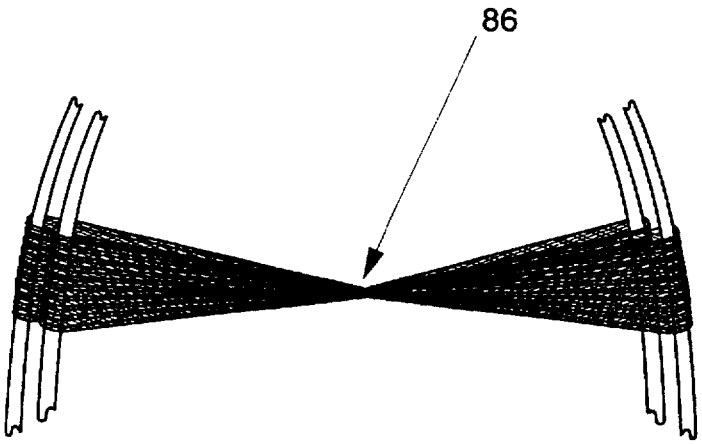
FIG. 16 is a perspective view of the heat pinch type of mesh binding member for a polymer mesh puff made in accordance with the present invention, and shown for clarity while the tubes of mesh are still stretched between the supports.

Still yet another preferred mesh binding member is a heat pinched section 86, as best illustrated in FIG. 16. Heat pinched section 86 is formed by exposing tubes of mesh 20 and 22 to a heat source such that a conglomeration of mesh is fused about the aggregate of the effective centerpoints 28 whereby a substantially permanent mesh binding member is formed. Thus, heat pinched section 86 is not a separate detachable structure from tubes of mesh 20 and 22, unlike the above-described preferred mesh binding members 30, but is rather integral to and part of tubes of mesh 20 and 22 following application of the heat source. The heat source used for fusing tubes of mesh 20 and 22 may be an electrically or thermally heated clamping iron or rollers, ultrasonic sealing, or the like.

The foregoing description of the preferred embodiments of the invention has been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application, and indeed to thereby enable utilization of the invention in various embodiments and with various modifications as are suited to the particular use contemplated. It is intended that the scope of the invention be defined by the claims appended hereto.

We claim:

1. A scrubbing apparatus comprising:

(a) a folded piece of open-cell mesh; and (b) a locking tether, the tether comprising a cord and a locking cleat, said locking cleat engaging said cord and maintaining a substantially permanent binding force when said locking tether is secured about the piece of mesh so as to encircle and substantially permanently hold the piece of mesh together.

2. The apparatus of claim 1, wherein the apparatus has a substantially spherical shape.

3. A scrubbing apparatus comprising:

(a) at least two folded pieces of open-cell mesh; and (b) a locking tether, the tether comprising a cord and a locking cleat, said locking cleat engaging said cord and maintaining a substantially permanent binding force when said locking tether is secured about the pieces of mesh so as to encircle and substantially permanently hold the pieces of mesh together.

4. The apparatus of claim 3, wherein the apparatus has a substantially spherical shape.

* * * * *